US012791019B2

(12) United States Patent
Miura et al.

(10) Patent No.: US 12,791,019 B2
(45) Date of Patent: Nov. 10, 2026

(54) DIAPHRAGM PUMP

(71) Applicant: NITTO KOHKI CO., LTD., Tokyo (JP)

(72) Inventors: Takayuki Miura, Tokyo (JP); Kosuke Kondo, Tokyo (JP)

(73) Assignee: NITTO KOHKI CO., LTD., Tokyo (JP)

( * ) Notice: Subject to any disclaimer, the term of this patent is extended or adjusted under 35 U.S.C. 154(b) by 0 days.

(21) Appl. No.: 19/176,618

(22) Filed: Apr. 11, 2025

(65) Prior Publication Data

US 2025/0237211 A1 Jul. 24, 2025

Related U.S. Application Data

(63) Continuation of application No. PCT/JP2023/023036, filed on Jun. 22, 2023.

(30) Foreign Application Priority Data

Oct. 21, 2022 (JP) ..... 2022-169135

(51) Int. Cl.
*F04B 43/02* (2006.01)
*F04B 43/00* (2006.01)

(52) U.S. Cl.
CPC ..... *F04B 43/02* (2013.01); *F04B 43/0054* (2013.01)

(58) Field of Classification Search
CPC ..... F04B 43/02; F04B 43/0054; F04B 43/04; F04B 45/04; F04B 45/047
See application file for complete search history.

(56) References Cited

U.S. PATENT DOCUMENTS 3,744,937 A * 7/1973 Collamore, Jr. ..... F04B 43/02 417/565
6,382,935 B1 * 5/2002 Mikiya ..... H02K 33/16 417/413.1

(Continued)

FOREIGN PATENT DOCUMENTS

JP S5440910 3/1979
JP S58187130 12/1983

(Continued)

OTHER PUBLICATIONS

English translation of JP2011225142(A) submitted by the Applicant from Espacenet Oct. 2, 2025 (Year: 2025).*

(Continued)

*Primary Examiner* — Bryan M Lettman
(74) *Attorney, Agent, or Firm* — Burris Law, PLLC

(57) ABSTRACT

The diaphragm pump includes a pump casing, a crank mechanism attached to the pump casing, and a diaphragm assembly connected to the crank mechanism. The diaphragm assembly has a diaphragm and a center plate retaining an inner peripheral portion of the diaphragm. The center plate has a first retaining member having a fitting recess, and a second retaining member having a fitting projection press-fitted into the fitting recess. The center plate clamps an inner peripheral portion of the diaphragm between the first retaining member and the second retaining member. A screw for securing the center plate is installed through insertion holes extending through the fitting recess and the fitting projection, respectively. The inner diameter of the fitting recess and the outer diameter of the fitting projection are larger than the insertion holes.

5 Claims, 6 Drawing Sheets

(56) References Cited

U.S. PATENT DOCUMENTS

| | | | | |
|---|---|---|---|---|
| 2014/0023532 | A1 | 1/2014 | Ishii et al. | |
| 2014/0023533 | A1* | 1/2014 | Ishii | F04B 45/043 417/413.1 |
| 2014/0271274 | A1* | 9/2014 | Ishii | F04B 45/047 417/413.1 |

FOREIGN PATENT DOCUMENTS

| | | | |
|---|---|---|---|
| JP | H09217733 | | 8/1997 |
| JP | 2004064827 | | 2/2004 |
| JP | 2008150959 | | 7/2008 |
| JP | 2011225142 | | 11/2011 |
| JP | 2011225142 | A * | 11/2011 |
| JP | 2012225190 | | 11/2012 |
| JP | 2021175599 | | 11/2021 |
| WO | 2013065344 | | 5/2013 |

OTHER PUBLICATIONS

International Search Report issued in corresponding International Application PCT/JP2023/023036, mailed Aug. 15, 2023.
Office Action issued in corresponding JP Application 2024-551219, mailed Jan. 20, 2026, 4 pages.
Office Action issued in corresponding JP Application 2024-551219, mailed Jun. 18, 2026, 4 pages.

* cited by examiner

DIAPHRAGM PUMP

CROSS-REFERENCE TO RELATED APPLICATIONS

This application is a continuation of International Application No. PCT/JP2023/023036, filed on Jun. 22, 2023, which claims priority to and the benefit of Japanese Patent Application No. 2022-169135, filed on Oct. 21, 2022. The disclosures of the above applications are incorporated herein by reference in their entireties.

FIELD

The present disclosure relates to a diaphragm pump configured to perform suction and discharge of a fluid by reciprocatively oscillating a diaphragm.

BACKGROUND

The statements in this section merely provide background information related to the present disclosure and may not constitute prior art.

Japanese Patent Application Publication No. 2012-225190, for example, shows a diaphragm pump having a center plate attached to the center of a disk-shaped diaphragm formed from an elastic member, e.g. rubber. The center plate is reciprocated by a driving mechanism, e.g. a crank mechanism or an electromagnetic reciprocating mechanism, thereby sucking and discharging a fluid such as air or water. The center plate comprises an inner center plate and an outer center plate, which are secured to the driving mechanism by being pressed down to each other using a screw with the diaphragm clamped therebetween. It should be noted that the outer center plate has a recess formed in the center thereof, and the inner center plate has a projection formed in the center thereof. By inserting the projection into the recess, the center positions of the outer and inner center plates are aligned with each other.

SUMMARY

This section provides a general summary of the disclosure and is not a comprehensive disclosure of its full scope or all of its features.

There has been a growing demand for the above-described diaphragm pump to attain a higher output and a higher flow rate. One of schemes for attaining a higher output and a higher flow rate is to increase the diameter of the diaphragm. In such a case, it is desirable to increase the size of the center plate in proportion to the increase in the diaphragm diameter. However, if the center plate is increased in size, the distance from the center position, at which the center plate is retained by the screw, to the outer peripheral end of the center plate becomes correspondingly longer, so that the center plate becomes more likely to be warped by a force received from the diaphragm when the center plate reciprocates. The warpage of the center plate causes a gap to be generated between the inner center plate and the outer center plate, which may make it impossible to maintain the state of retaining the diaphragm, resulting in the diaphragm dislodging from the center plate.

Accordingly, the present disclosure provides a diaphragm pump configured so that the center plate is less likely to warp even if the center plate is increased in diameter.

That is, the present disclosure provides a diaphragm pump including: a pump casing; a driving mechanism section attached to the pump casing; a diaphragm having an outer peripheral portion and an inner peripheral portion, the outer peripheral portion being secured to the pump casing; a center plate connected to the driving mechanism section and retaining the inner peripheral portion of the diaphragm, the center plate having a first retaining member having a fitting recess, and a second retaining member having a fitting projection press-fitted into the fitting recess, the center plate being configured to clamp the inner peripheral portion of the diaphragm between the first retaining member and the second retaining member, and the center plate having an insertion hole extending through the fitting recess and the fitting projection; and a securing member installed through the insertion hole to secure the diaphragm to the driving mechanism section through the center plate; wherein the inner diameter of the fitting recess and the outer diameter of the fitting projection are larger than the insertion hole.

In the diaphragm pump, the first retaining member and second retaining member of the center plate are secured to each other by fitting of the fitting recess and the fitting projection, which are larger than the insertion hole through which the securing member is installed. Therefore, it is possible to shorten the distance from the position at which the first and second retaining members are secured to each other to the outer peripheral end of the center plate. Consequently, it is possible to make it less likely that the first retaining member and second retaining member of the center plate will be warped even if the first retaining member and the second retaining member receive a force from the diaphragm in a direction away from each other during pump operation. In particular, even when the center plate is increased in diameter, the occurrence of warpage during pump operation can be inhibited by increasing the fitting recess and the fitting projection in diameter correspondingly.

In addition, the arrangement may be as follows. Not all of the outer peripheral surface of the fitting projection engages the inner peripheral surface of the fitting recess so that an accommodating space is formed between the inner peripheral surface of the fitting recess and the outer peripheral surface of the fitting projection. More specifically, the arrangement may be such that the fitting projection has a radially inwardly hollow portion, so that the accommodating space is formed by the hollow portion. Even more specifically, the arrangement may be such that the fitting projection has a plurality of the hollow portions equally spaced in a circumferential direction, whereby a plurality of radially outwardly projecting portions are formed, and only outer peripheral surfaces of the plurality of projecting portions engage the inner peripheral surface of the fitting recess.

By providing the accommodating spaces between the inner peripheral surface of the fitting recess and the outer peripheral surface of the fitting projection, deformed portions of the fitting recess and the fitting projection which are generated when the fitting projection is press-fitted into the fitting recess are allowed to enter the accommodating spaces. Consequently, it is possible to secure the first retaining member and the second retaining member to each other by firmly fitting together the fitting recess and the fitting projection and, at the same time, possible to inhibit occurrence of warpage or other undesired deformation of the first and second retaining members when assembled together due to an excessive stress otherwise generated in other portions of the first and second retaining members.

BRIEF DESCRIPTION OF THE DRAWINGS

In order that the disclosure may be well understood, there will now be described various forms thereof, given by way of example, reference being made to the accompanying drawings, in which.

Figure 1:
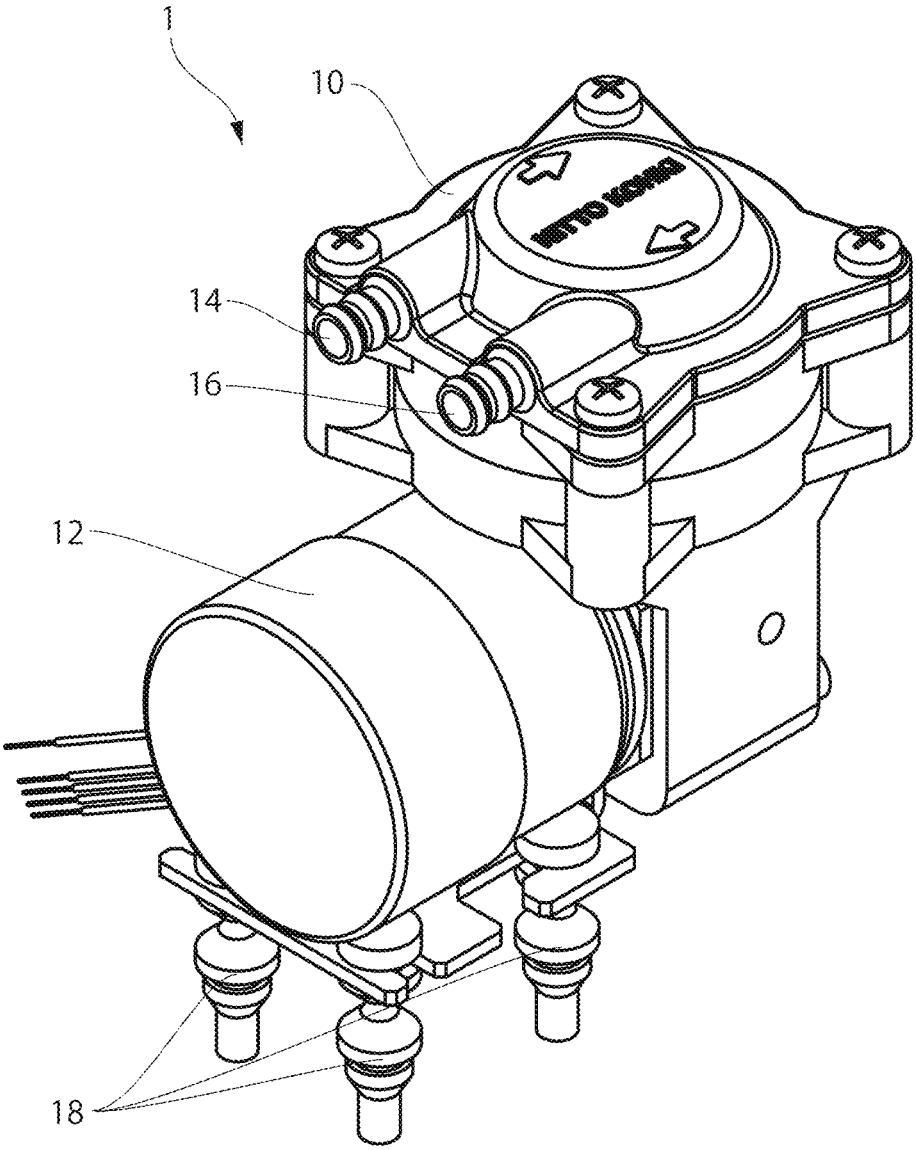
FIG. 1 is a perspective view of a diaphragm pump according to the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

As shown in FIG. 1, a diaphragm pump 1 according to the various teachings of the present disclosure includes a pump casing 10 and a motor 12 attached to the pump casing 10. The pump casing 10 is provided with a suction port 14 and a discharge port 16. The diaphragm pump 1 is configured to suck in air from the suction port 14 and to discharge the air from the discharge port 16 by reciprocating a diaphragm assembly 22 (described later) built in the pump casing 10 by using the motor 12. The diaphragm pump 1 is configured to be installed at a predetermined position through rubber vibration isolators 18.

Figure 2:
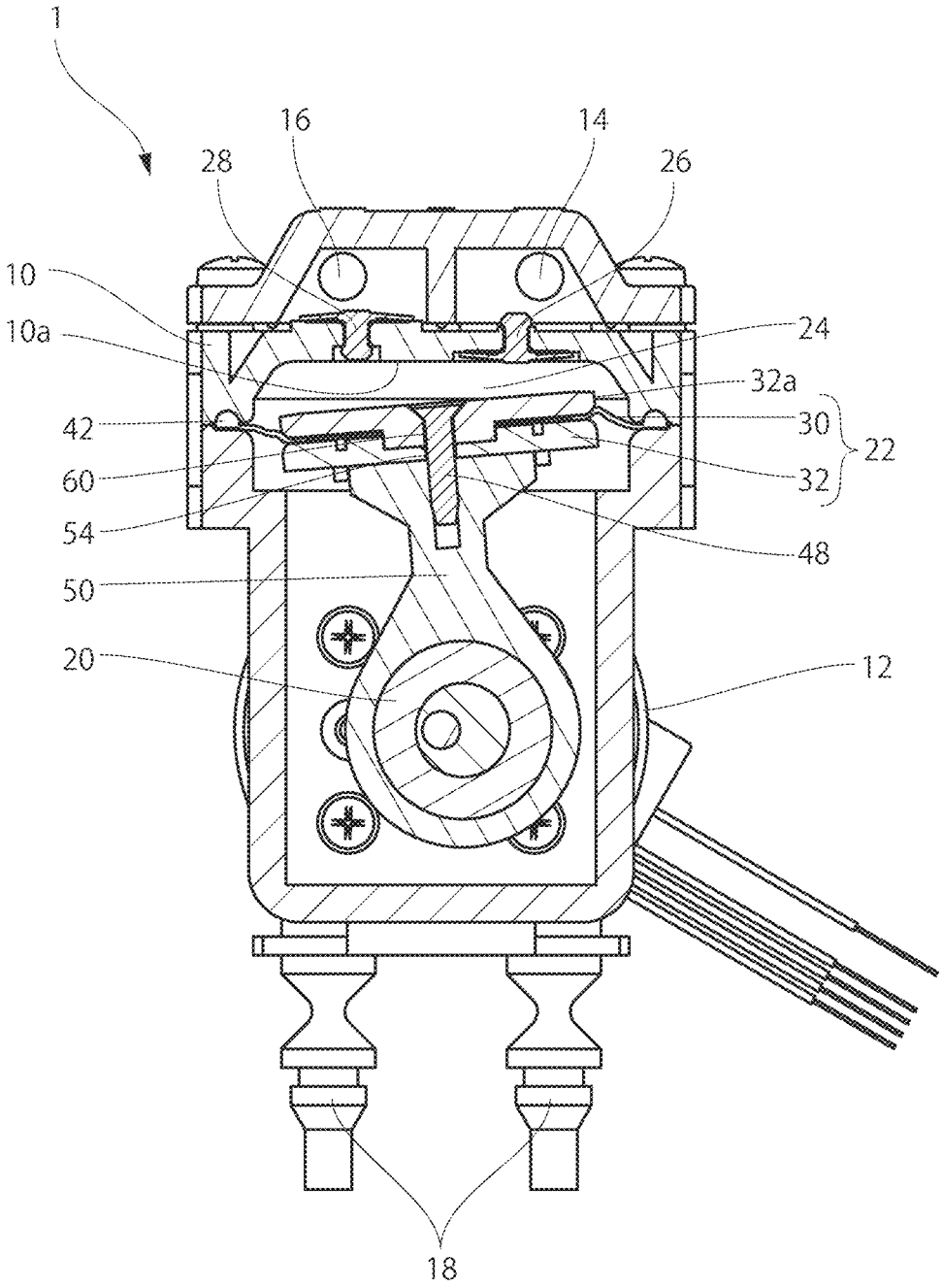
FIG. 2 is a sectional view of the diaphragm pump in FIG. 1, taken at the center position of a diaphragm.

As shown in FIG. 2, the diaphragm pump 1 further includes a crank mechanism 20 coupled to the motor 12, and a diaphragm assembly 22 attached to the crank mechanism 20. A pump chamber 24 is formed between an inner peripheral surface 10*a* of the pump casing 10 and the diaphragm assembly 22. A one-way valve 26 is installed between the suction port 14 and the pump chamber 24. The one-way valve 26 allows air to flow only from the suction port 14 to the pump chamber 24. In addition, a one-way valve 28 is installed between the pump chamber 24 and the discharge port 16. The one-way valve 28 allows air to flow only from the pump chamber 24 to the discharge port 16. The diaphragm assembly 22 is reciprocated mainly in an up-down direction by the crank mechanism 20, thereby causing the volumetric capacity of the pump chamber 24 to increase and decrease, and thus allowing air to be sucked into the pump chamber 24 from the suction port 14 and delivered from the pump chamber 24 to the discharge port 16.

Figure 3:
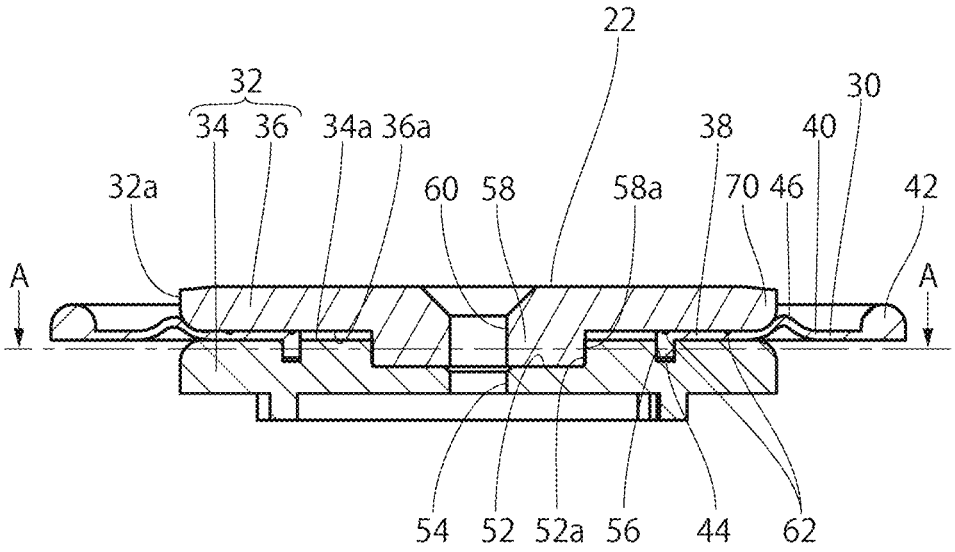
FIG. 3 is a sectional view of a diaphragm assembly.

The diaphragm assembly 22 includes a disk-shaped diaphragm 30 and a center plate 32 retaining the diaphragm 30. As shown in FIG. 3, the center plate 32 includes a first (lower) retaining member 34 and a second (upper) retaining member 36 and retains the diaphragm 30 by clamping an inner peripheral portion 38 of the diaphragm 30 between the first and second retaining members 34 and 36. The diaphragm 30 has an outer peripheral locking portion 42 projecting upwardly at an outer peripheral portion 40 thereof, an inner peripheral locking portion 44 projecting downwardly at an inner peripheral portion 38 thereof, and an intermediate curved portion 46 curved upwardly at an intermediate portion thereof. As shown in FIG. 2, the outer peripheral locking portion 42 of the diaphragm 30 is secured to the pump casing 10. In addition, the center plate 32 is secured to a connecting rod 50 of the crank mechanism 20 with a screw (securing member) 48.

Figure 4:
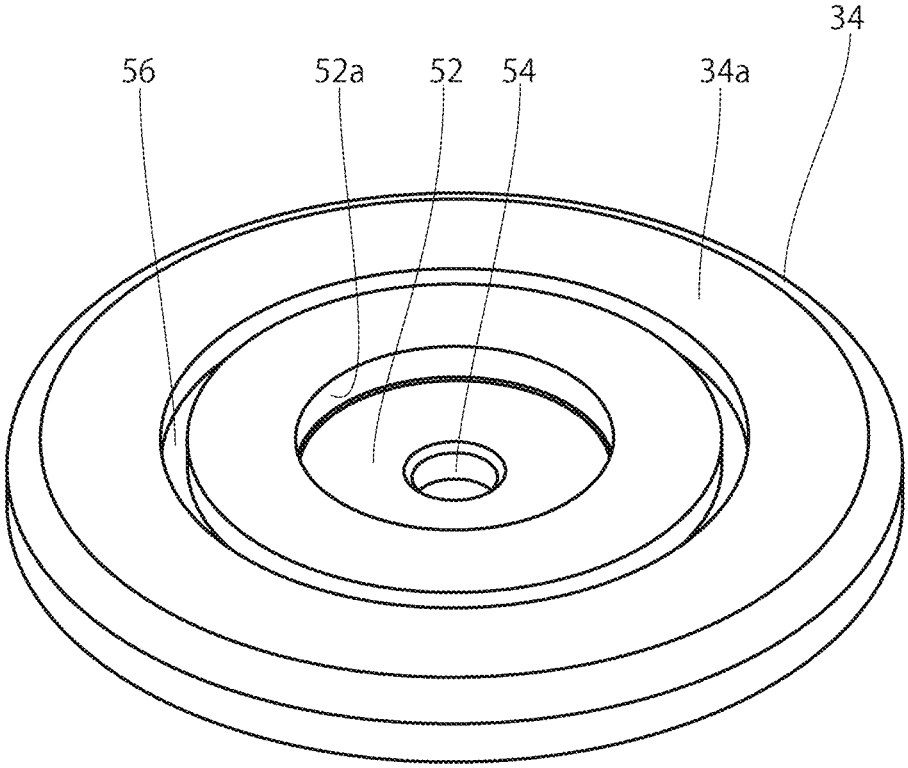
FIG. 4 is a perspective view of an upper surface of a first retaining member of a center plate.
Figure 5:
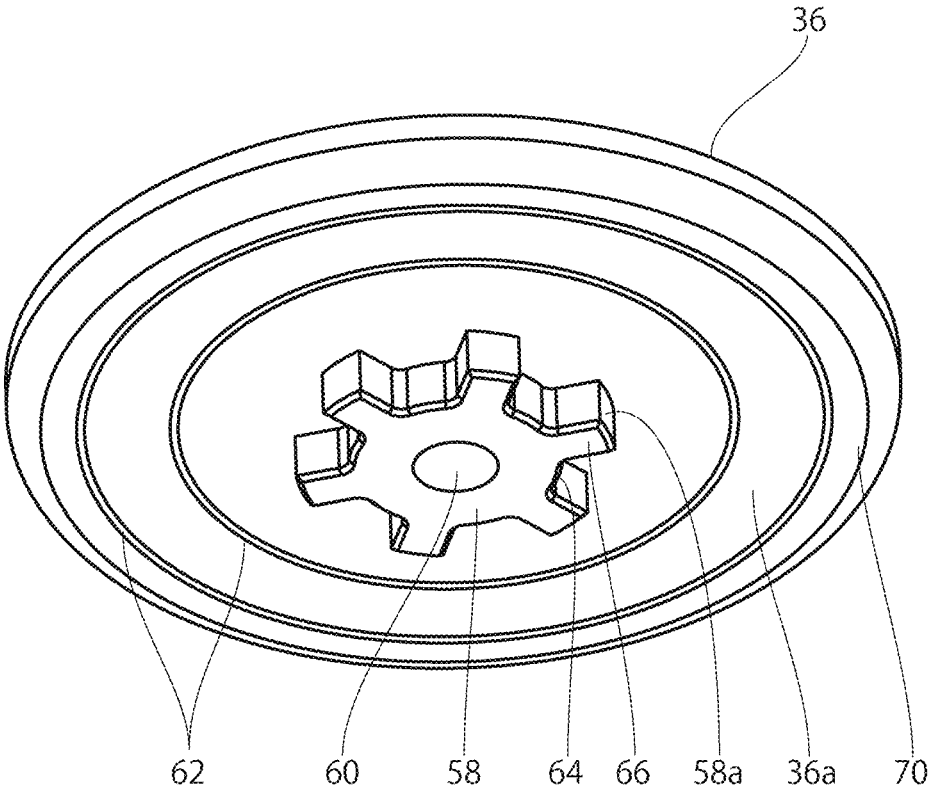
FIG. 5 is a perspective view of a lower surface of a second retaining member of the center plate.

As shown in FIG. 4, the first retaining member 34 of the center plate 32 has a circular fitting recess 52 in an upper surface 34*a* thereof and an insertion hole 54 extending through the center position of the fitting recess 52. The first retaining member 34 further has an annular locking groove 56 formed in the upper surface 34*a* at a position outward of the fitting recess 52. As shown in FIG. 5, the second retaining member 36 of the center plate 32 has a fitting projection 58 on a lower surface 36*a* thereof and an insertion hole 60 extending through the center position of the fitting projection 58. The second retaining member 36 further has two annular protrusions 62 formed on the lower surface 36*a* at respective positions outward of the fitting projection 58. The fitting projection 58 has six radially inwardly hollow portions 64 which are equally spaced circumferentially, whereby six projecting portions 66 are formed. The fitting projection 58 has the shape like a gear wheel.

Figure 6:
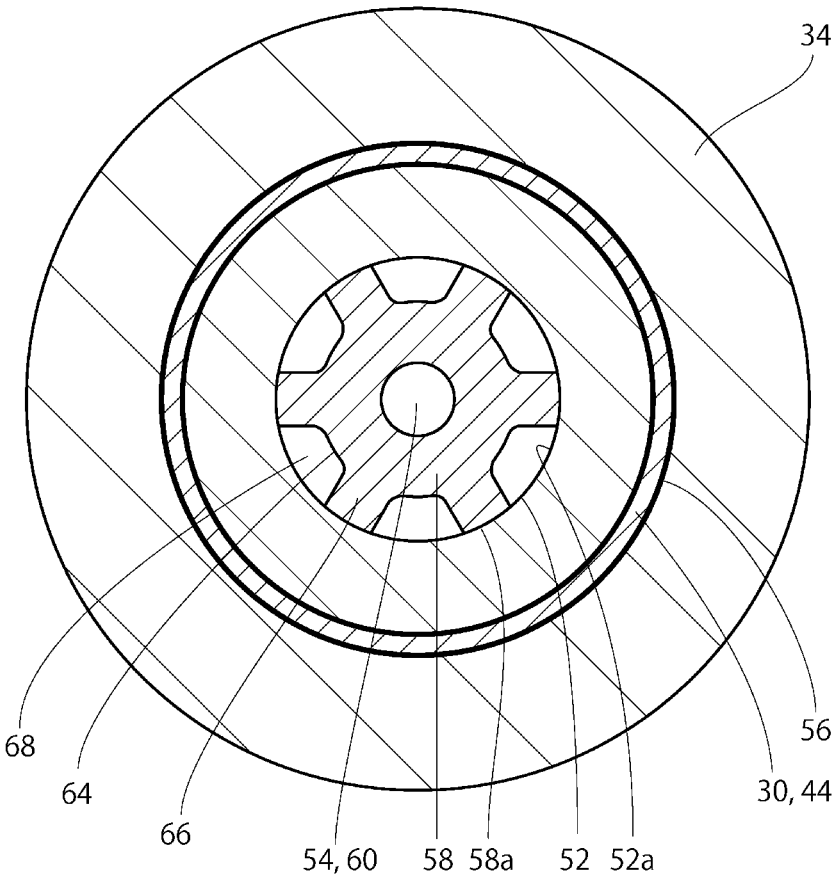
FIG. 6 is a sectional view taken along the line A-A in FIG. 3.

As shown in FIG. 3, the diaphragm assembly 22 is assembled by fitting the inner peripheral locking portion 44 of the diaphragm 30 into the annular locking groove 56 of the first retaining member 34, and in this state, press-fitting the fitting projection 58 of the second retaining member 36 into the fitting recess 52 of the first retaining member 34. The inner peripheral portion 38 of the diaphragm 30 is clamped between the upper surface 34*a* of the first retaining member 34 and the lower surface 36*a* of the second retaining member 36 to be retained therebetween. In addition, the two annular protrusions 62 of the second retaining member 36 bite into the diaphragm 30, thereby enabling the diaphragm 30 to be retained even more firmly. As shown in FIG. 6, accommodating spaces 68 are formed in the hollow portions 64 of the fitting projection 58 between the fitting projection 58 and the fitting recess 52. The fitting projection 58 engages an inner peripheral surface 52*a* of the fitting recess 52 only at an outer peripheral surface 58*a* of each projecting portion 66. Before the diaphragm assembly 22 is assembled, the outer diameter of the fitting projection 58 is substantially the same as or slightly greater than the inner diameter of the fitting recess 52. Accordingly, when the fitting projection 58 is press-fitted into the fitting recess 52, the projecting portions 66 of the fitting projection 58 or the fitting recess 52 may be slightly deformed. However, the deformed portions may escape into the adjacent accommodating spaces 68; therefore, not much undue stress is applied to other portions. If the accommodating spaces 68 were not provided, there would be no way out for the deformed portions, so that a large stress might be applied to other portions, particularly to the base of the fitting projection 58 and the vicinity thereof. This could result in the second retaining member 36 warping as a whole. In contrast, this form of the present disclosure can inhibit the occurrence of warpage during the assembling process owing to the accommodating spaces 68 being provided. It should be noted that the shape and number of the projecting portions 66 and the accommodating spaces 68 can be changed as desired. In addition, accommodating spaces may be formed by forming radially outwardly hollow portions in the inner peripheral surface 52*a* of the fitting recess 52. Other various shapes are also conceivable for the accommodating spaces. That is, any shape is usable, provided that when the fitting projection 58 is press-fitted into the fitting recess 52, not all of, or only a part of, the outer peripheral surface 58*a* of the fitting projection 58 engages the inner peripheral surface 52*a* of the fitting recess 52 and accommodating spaces are formed in other portions.

The assembled diaphragm assembly 22 is secured to the connecting rod 50 of the crank mechanism 20 by using the screw 48, as described above. It should, however, be noted that the first retaining member 34 and the second retaining member 36 of the center plate 32 are practically secured to each other by fitting between the fitting recess 52 and the fitting projection 58.

In the diaphragm pump 1, the first retaining member 34 and the second retaining member 36 of the center plate 32 retaining the diaphragm 30 are integrally secured to each other not by the screw 48 but mainly by fitting between the fitting recess 52 and the fitting projection 58. The inner diameter of the fitting recess 52 and the outer diameter of the fitting projection 58 are larger than the insertion holes 54 and 60; therefore, the distance from the inner and outer peripheral surfaces 52*a* and 58*a* of the fitting recess 52 and the fitting projection 52, which are fitted to each other, to an outer peripheral end 32*a* of the center plate 32 is shorter than the distance from the screw 48 to the outer peripheral end 32*a* of the center plate 32. During pump operation, an outer peripheral portion 70 of the second retaining member 36 of the center plate 32 is subjected to a force from the diaphragm 30 in a direction away from the first retaining member 34. However, because the distance from the outer peripheral surface 58*a* of the fitting projection 58, at which the second retaining member 36 is secured to the first retaining member 34, to the outer peripheral end 32*a* thereof has been shortened, the second retaining member 36 is less likely to warp in comparison to a case where the first retaining member 34 and the second retaining member 36 are secured to each other only with the screw 48. In addition, because the fitting recess 52 and the fitting projection 58 are fitted to each other, the first retaining member 34 and the second retaining member 36 are inhibited from rotating relative to each other. Thus, it is possible to inhibit application of undesired force to the diaphragm 30, which would otherwise be caused by rotation of the second retaining member 36 when the screw 48 is tightened, and also possible to inhibit the screw 48 from becoming loose during pump operation, which would otherwise be caused by rotation of the second retaining member 36.

Although some variations of the present disclosure have been described above, the present disclosure is not limited to these variations. For example, the first retaining member of the center plate may be formed as a component integrated with the connecting rod of the crank mechanism. In addition, the second retaining member of the center plate may be secured to the crank mechanism, and the first retaining member may be secured to the second retaining member. In other words, the fitting projection may be formed on the connecting rod-side member, and the fitting recess may be formed in the other member. Although in the foregoing variation a structure comprising a motor and a crank mechanism is adopted as a driving mechanism section, other mechanisms, for example, an electromagnetic reciprocating mechanism, may also be usable. In addition, a fluid to be conveyed is not limited to air but may be a liquid, for example, water.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A diaphragm pump comprising:

a pump casing;

a driving mechanism section attached to the pump casing;

a diaphragm having an outer peripheral portion and an inner peripheral portion, the outer peripheral portion coupled to the pump casing;

a center plate connected to the driving mechanism section and retaining the inner peripheral portion of the diaphragm, the center plate having a first retaining member having a fitting recess, and a second retaining member having a fitting projection press-fitted into the fitting recess, the center plate being configured to clamp the inner peripheral portion of the diaphragm between the first retaining member and the second retaining member, and the center plate having an insertion hole extending through the fitting recess and the fitting projection, wherein the first retaining member and the second retaining member are integrally secured to each other by a fitting between the fitting recess and the fitting projection with the diaphragm clamped therebetween; and a securing member installed through the insertion hole to secure the diaphragm to the driving mechanism section through the center plate, wherein the fitting projection has a plurality of radially outwardly projecting portions, and only outer peripheral surfaces of the plurality of projecting portions engage an inner peripheral surface of the fitting recess, wherein accommodating spaces are formed between the inner peripheral surface of the fitting recess and an outer peripheral surface of the fitting projection and the plurality of projecting portions are configured to be deformed into the accommodating spaces, and wherein an inner diameter of the fitting recess and an outer diameter of the fitting projection are larger than the insertion hole.

2. The diaphragm pump of claim 1, wherein the fitting projection has a plurality of radially inwardly hollow portions and the accommodating spaces are formed by the plurality of hollow portions.

3. The diaphragm pump of claim 2, wherein the plurality of hollow portions are equally spaced in a circumferential direction.

4. A diaphragm pump comprising:

a pump casing;

a driving mechanism section attached to the pump casing;

a diaphragm having an outer peripheral portion and an inner peripheral portion, the outer peripheral portion coupled to the pump casing;

a center plate connected to the driving mechanism section and retaining the inner peripheral portion of the diaphragm, the center plate having a first retaining member having a fitting recess, and a second retaining member having a fitting projection press-fitted into the fitting recess, the center plate being configured to clamp the inner peripheral portion of the diaphragm between the first retaining member and the second retaining member, and the center plate having an insertion hole extending through the fitting recess and the fitting projection, wherein the first retaining member and the second retaining member are integrally secured to each other by a fitting between the fitting recess and the fitting projection with the diaphragm clamped therebetween; and a securing member installed through the insertion hole to secure the diaphragm to the driving mechanism section through the center plate, wherein the fitting projection has a plurality of radially inwardly hollow portions, whereby a plurality of radially outwardly projecting portions are formed, and only outer peripheral surfaces of the plurality of projecting portions engage an inner peripheral surface of the fitting recess, wherein accommodating spaces are formed by the plurality of hollow portions between the inner peripheral surface of the fitting recess and an outer peripheral surface of the fitting projection and the plurality of projecting portions are configured to be deformed into the accommodating spaces, and wherein an inner diameter of the fitting recess and an outer diameter of the fitting projection are larger than the insertion hole.

5. A diaphragm pump comprising:

a pump casing;

a driving mechanism section attached to the pump casing;

a diaphragm having an outer peripheral portion and an inner peripheral portion, the outer peripheral portion coupled to the pump casing;

a center plate connected to the driving mechanism section and retaining the inner peripheral portion of the diaphragm, the center plate having a first retaining member having a fitting recess, and a second retaining member having a fitting projection press-fitted into the fitting recess, the center plate being configured to clamp the inner peripheral portion of the diaphragm between the first retaining member and the second retaining member, and the center plate having an insertion hole extending through the fitting recess and the fitting projection, wherein the first retaining member and the second retaining member are integrally secured to each other by a fitting between the fitting recess and the fitting projection with the diaphragm clamped therebetween; and a securing member installed through the insertion hole to secure the diaphragm to the driving mechanism section through the center plate, wherein the fitting recess has a plurality of radially outwardly hollow portions, whereby a plurality of radially inwardly projecting portions are formed, and only inner peripheral surfaces of the plurality of projecting portions engage an outer peripheral surface of the fitting projection, wherein accommodating spaces are formed by the plurality of hollow portions between an inner peripheral surface of the fitting recess and the outer peripheral surface of the fitting projection and the plurality of projecting portions are configured to be deformed into the accommodating spaces, and wherein an inner diameter of the fitting recess and an outer diameter of the fitting projection are larger than the insertion hole.

* * * * *